US007857409B2

(12) United States Patent
Hayashi et al.

(10) Patent No.: US 7,857,409 B2
(45) Date of Patent: Dec. 28, 2010

(54) INK JET PRINTING APPARATUS AND INK JET PRINTING METHOD

(75) Inventors: Satoshi Hayashi, Yokohama (JP); Masaki Nitta, Yokohama (JP); Taku Yokozawa, Yokohama (JP); Nobuhiko Takekoshi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 547 days.

(21) Appl. No.: 11/753,712

(22) Filed: May 25, 2007

(65) Prior Publication Data

US 2007/0279444 A1 Dec. 6, 2007

(30) Foreign Application Priority Data

Jun. 6, 2006 (JP) ..... 2006-157664

(51) Int. Cl.
*B41J 29/38* (2006.01)

(52) U.S. Cl. ..... 347/14; 347/17; 347/19

(58) Field of Classification Search ..... 347/5, 347/9–11, 14, 17, 19, 60, 57, 61
See application file for complete search history.

(56) References Cited

U.S. PATENT DOCUMENTS 5,861,895 A 1/1999 Tajika et al.
6,439,696 B1 8/2002 Murakami et al.
6,769,755 B2 * 8/2004 Mizutani et al. ..... 347/14

FOREIGN PATENT DOCUMENTS

| | | |
|---|---|---|
| JP | 7-125260 | 5/1995 |
| JP | 8-216392 | 8/1996 |
| JP | 3158381 | 2/2001 |
| JP | 2001-180015 | 7/2001 |
| JP | 3247412 | 11/2001 |
| JP | 2004-1435 | 1/2004 |

* cited by examiner

*Primary Examiner*—Thinh H Nguyen
(74) *Attorney, Agent, or Firm*—Fitzpatrick, Cella, Harper & Scinto

(57) ABSTRACT

An ink jet printing apparatus is provided that can realize a stable ejection volume with the minimum change in a voltage value supplied in a scanning. To realize this, when a detected temperature of a print head is included in a first range, a pulse width control is performed while a voltage being fixed to a first voltage. When a detected temperature is included in a second range, a pulse width control is performed while a voltage being fixed to a second voltage. In the pulse width control based on the two voltages, a temperature partially overlapped region is provided between the first range and the second range. By this, even when a print head has an increased temperature during a print scanning, an ejection volume can be controlled, in the print scanning, while minimizing the switching of a driving voltage.

7 Claims, 13 Drawing Sheets

INK JET PRINTING APPARATUS AND INK JET PRINTING METHOD

BACKGROUND OF THE INVENTION

1. Field of the Invention

The present invention relates to an ink jet printing apparatus and an ink jet printing method that uses a print head for ejecting ink droplets to a print medium to form an image.

2. Description of the Related Art

An ink jet printing apparatus includes a print head in which a great number of print elements for discharging ink based on print information are arranged. In a serial-type ink jet printing apparatus, a main scanning operation for scanning a carriage mounting a print head in parallel with the flat surface of a print medium for printing and a transportation for transporting the print medium in a direction crossing the main scanning are alternately performed to form an image.

Some structures for ejecting ink from a print element have been already suggested and carried out. Among them, a structure in which a print element includes an electrothermal conversion element (heater) has been widely used because this structure can eject small ink droplets with a high density and a high frequency. In such an ink jet print head, each of print elements includes a liquid path for introducing ink to a ejecting opening and an electrothermal conversion element (heater) having a contact with ink in the liquid path.

When ink is ejected from a print element depending on an image signal, each heater is applied with a predetermined voltage pulse to heat a heater to heat ink. When being suddenly heated, film boiling is caused in ink having a contact with the surface of the heater to cause bubbles. The bubbles grow to push ink out. The ejected ink droplets fly to reach the print medium, thereby forming dots.

An ejection volume is directly influenced by a temperature of ink in the vicinity of the heater. For example, a print head having a low temperature causes a smaller volume of bubbles, a smaller ejection volume, and a smaller area of printed dots. A print head having a high temperature on the contrary causes a larger volume of bubbles, a larger ejection volume, and a larger area of printed dots. Specifically, a print head having an unstable temperature causes, even when identical image data is subjected to a printing operation, variation in the size of dots formed on a print medium and thus in the image density, causing a risk of uneven density.

A print head including a heater cannot structurally avoid fluctuation or variation in the ink temperature due to an environment in which the apparatus is used or the frequency of use of the respective color heads. However, variation in an image density in an ink jet printing apparatus due to reasons other than data is not preferred from the viewpoint of quality. Thus, stabilization of an ejection volume of a print head has been a major objective of an ink jet printing apparatus.

Japanese Patent No. 3247412 discloses a technique by which a voltage pulse is applied two times for one ink ejecting operation and a pulse width is controlled in a stepwise manner depending on the temperature of a print head to stabilize an ejection volume. Hereinafter, such a control of an ejection volume will be referred to as a PWM (Pulse Width Modulation) driving control.

FIG. 1A is a timing chart for explaining the PWM driving control. In FIG. 1A, the horizontal axis represents time and the vertical axis represents a value of a voltage applied to a heater. The two pulses shown in FIG. 1A are used to perform one ink ejection. In FIG. 1A, "P1" denotes a time during which a preheat pulse is applied, "P3" denotes a time during which a main heat pulse is applied, and "P2" denotes an interval between a preheat pulse and a main heat pulse.

A preheat pulse is a pulse applied to heat ink in the vicinity of the surface of a heater and is applied for the application time P1 so as not to cause energy causing foaming. The interval is determined so that mutual interference between a preheat pulse and a main heat pulse is prevented, thermal energy obtained by a preheat pulse is dispersed in ink, and a preferred temperature distribution is obtained. A main heat pulse on the other hand is a pulse applied to cause ink heated by a preheat pulse to have film boiling to perform ink ejection and is applied for the application time P3 longer than the application time P1 so as to provide sufficient energy causing foaming. A main heat pulse has a pulse width P3 determined based on a heater area, a resistance value, a film structure, or the structure of a liquid path.

As described above, an ink ejection volume depends on the temperature distribution of ink in the vicinity of a heater. Japanese Patent No. 3247412 adjusts, depending on a detected temperature, a pulse width P1 of a preheat pulse or an interval time P2 (input energy and input time) to control the ink temperature distribution (i.e., foaming region) to control an ink ejection volume. This will be described specifically. When a detected temperature gradually increases for example, the necessity for heating ink at the surface of a heater is gradually reduced. In this case, the preheat pulse width P1 is gradually reduced. When a detected temperature gradually decreases on the other hand, the necessity for heating ink at the surface of a heater is increased and thus the preheat pulse width P1 is gradually increased.

When heat is more accumulated at the print head to reach the preheat pulse P1 of 0, only a main heat pulse as shown in FIG. 1B is used as a driving pulse and further PWM driving control is impossible. Specifically, the PWM driving control disclosed in Japanese Patent No. 3247412 can control an ink ejection volume in a temperature range until the preheat pulse P1 is 0.

Japanese Patent Laid-Open No. 2001-180015 on the other hand discloses a method to stabilize an ink ejection volume by simultaneously changing an applied voltage value and a pulse width.

FIG. 2 is a timing chart for explaining the driving control method disclosed in Japanese Patent Laid-Open No. 2001-180015. An ink jet print head having a heater is characterized in that a pulse 302 for applying a high voltage Vop2 to a heater for a short time causes a smaller ink ejection volume than that caused by a pulse 301 for applying a low voltage Vop1 to a heater for a longer time. The reason will be described hereinafter.

When a voltage pulse is applied to a heater, ink in the vicinity of the boundary surface of a heater is firstly heated to transmit heat to ink at the periphery. Further heating of the ink causes ink in the vicinity of the boundary surface to foam to eject ink in an amount corresponding to the volume of the foamed ink. The volume of foamed ink depends on the number of molecules of vaporized ink. This number of molecules of vaporized ink is determined based on the volume of ink receiving sufficient heat quantity from the heater until the ink foaming is caused. In this case, an increased voltage applied to an electrothermal conversion element starts the vaporization of ink near the boundary surface with a smaller range in which heat can be transmitted to ink. Since gas has a very small thermal conductivity, the heater after the ink foaming is substantially heat-insulative to substantially prevent heat from being newly transferred to liquid existing at the periphery. As a result, the volume of vaporized ink molecules of small number is a volume of foamed ink, thus causing a smaller amount of ink to be ejected.

Japanese Patent Laid-Open No. 2001-180015 uses the characteristic as described above for controlling an ink ejection volume. Specifically, when an increased ink ejection volume is desired, a pulse shape is determined so that a driving voltage is reduced and a pulse width is increased. When a reduced ink ejection volume is desired, a pulse shape is determined so that a driving voltage is increased and a pulse width is reduced. Although the above description has been made with a single pulse for simplicity, such a characteristic also can be checked by using a double pulse.

Japanese Patent No. 3158381 discloses a technique that combines the general PWM control disclosed in Japanese Patent No. 3247412 with the technique disclosed in Japanese Patent Laid-Open No. 2001-180015 so that a PWM driving control can be performed in a further broader temperature range. According to the general PWM driving control as disclosed in Japanese Patent No. 3247412, the driving voltage Vop is retained constant in all controllable temperature regions. At a temperature higher than that of a condition in which a preheat pulse width is 0 as shown in FIG. 1B, the control of an ink ejection volume is impossible. However, even in such as high temperature region, an ejection volume control width can be further expanded to a high temperature range by resetting a driving voltage at a further higher value.

FIG. 3 shows an example of a pulse table when the two driving voltages vop1 and voP2 are used to perform the PWM driving control. A print head includes a temperature sensor for detecting the temperature of ink near a heater. A detected temperature is compared with a threshold temperature value to select a corresponding pulse. When detected temperature show a relation of T1<T<T2 for example, a pulse of tb15 is set. When detected temperature show a relation of T1<T<T6, five pulses of tb15 to tb11 correspond, these driving voltages are fixed to Vop1. Specifically, in a temperature region of T1<T<T6, the PWM control based on the driving voltage Vop1 is performed.

When detected temperature show a relation of T6<T<T11 on the other hand, five pulses of tb25 to tb21 are prepared, these driving voltages are fixed to Vop2 higher than Vop1. Specifically, in a temperature region of T6<T<T11, the PWM control based on the driving voltage Vop2 is performed. FIG. 4 illustrates the PWM control explained above. In FIG. 4, as the detected temperature T is higher, an applicable table is selected in order. A control range TW includes two types of PWM control regions, which are PWM control region for 20.5V and PWM control region for 24.0V. It is understandable that the two types of PWM control are switched on reaching 60 degrees. When the driving control is performed in such a high temperature region based on a high driving voltage, the heater is applied with a lower energy than in the case of the driving with a lower voltage. Thus, further accumulation of heat at the print head can be more actively suppressed.

As described above, the PWM driving control method in two steps can be performed in a continuous manner to control an ejection volume of a print head in a broader temperature range (T1 to T11).

By the way, as described above for the serial-type ink jet printing apparatus, when a relatively small printing apparatus for consumers for example is subjected to a driving control, the detection of a temperature of a print head and the switching of a driving pulse may be performed at every timing of main scanning for a print operation is performed. The reason is that, in such a printing apparatus, temperature fluctuation during one print scanning is not so high and density fluctuation can be suppressed to prevent a problematic image quality so long as a pulse is reconsidered and switched whenever a print scanning is performed.

In the case of a large ink jet printing apparatus for business use on the other hand, a print scanning is performed over a longer distance to cause a proportionally higher temperature fluctuation during a print scanning. Specifically, such density fluctuation may be caused during a print scanning that causes a problematic image quality. Thus, such a large ink jet printing apparatus is desirably structured so that a temperature of a print head is detected and a driving pulse is switched even during each print scanning.

However, although a pulse width can be changed during a print scanning, a driving voltage is difficultly changed. For example, with reference to FIG. 3, when a detected temperature fluctuates from T5 to T6 during a print scanning, two different voltages of Vop1 and Vop2 are demanded to be supplied in a single print scanning. In order to realize this, a more complicated and larger power source supply circuit is required, thus causing a significant increase of cost.

SUMMARY OF THE INVENTION

The present invention has been made in order to solve the above problems. It is an objective of the invention to provide an ink jet printing apparatus that can realize a stable ink ejection volume while minimizing the change in a voltage value supplied during a single scanning, even when the invention is applied to a large ink jet printing apparatus.

In the first aspect of the present invention, there is provided an ink jet printing apparatus for performing a printing operation by using a print head including a plurality of print elements for ejecting ink, comprising: detecting means for detecting a temperature of the print head; setting means for setting, depending on the temperature detected by the detecting means, voltages and pulse widths of a preheat pulse and a main heat pulse; and means for driving the print element, based on the voltages and pulse widths set by the setting means, applying the preheat pulse and the main heat pulse to a heater included in the print element, wherein when the temperature detected by the detecting means is included in a predetermined temperature region, a plurality of voltages and pulse widths that can be set by the setting means are prepared.

In the second aspect of the present invention, there is provided an ink jet printing apparatus using a print head including a plurality of print elements for ejecting ink by applying a pulse to a heater for performing a printing operation, comprising: obtaining means for obtaining a temperature information of the print head; a table storing a pulse information including a pulse width information and a voltage information corresponding to the temperature information; selection means for selecting, depending on the obtained temperature information, the pulse information from the table; and driving means for driving the print elements based on the pulse information selected by the selection means; wherein the table stores a plurality of pulse information each including different voltage information corresponding to the same temperature information within a predetermined temperature range, and including pulse width information corresponding to the voltage information.

In the third aspect of the present invention, there is provided an ink jet printing apparatus for performing a printing operation by scanning a print head including a plurality of print elements for ejecting ink, comprising: obtaining means for obtaining a temperature information of the print head; driving means for driving the print elements by using a pulse signal consist of a preheat pulse and a main heat pulse; selection means for selecting a voltage value of the pulse signal based on the temperature information obtained by the obtaining means and for selecting a pulse width corresponding to the voltage value at every scanning operation of the print head; and control means for starting to drive the print elements based on the voltage value and the pulse width selected the selection means for the scanning operation of the print head, and for changing the pulse width during the scanning operation of the print head, based on the temperature information obtained the obtaining means.

In the fourth aspect of the present invention, there is provided an ink jet printing method for performing a printing operation by using a print head including a plurality of print elements for ejecting ink, comprising steps of: detecting a temperature of the print head; setting, depending on the detected temperature, voltages and pulse widths of a preheat pulse and a main heat pulse; and driving the print elements by applying, based on the voltages and the pulse widths set by the setting step, the preheat pulse and the main heat pulse to a heater included in the print element, wherein, when the detected temperature is included in a predetermined temperature region, a plurality of voltages and pulse widths that can be selected by the selection means are prepared.

In the fifth aspect of the present invention, there is provided an ink jet printing method for performing a printing operation by scanning a print head including a plurality of print elements for ejecting ink, comprising steps of: obtaining a temperature information of the print head; driving the print elements by using a pulse signal consist of a preheat pulse and a main heat pulse; selecting a voltage value of the pulse signal based on the temperature information obtained by the obtaining step and a pulse width corresponding to the selected voltage value for every scanning operation of the print head; and controlling for starting the driving step based on the voltage value and the pulse width selected by the selection step for the scanning operation of the print head, and for changing the pulse width based on the temperature information obtained by the obtaining step during the scanning operation of the print head.

Further features of the present invention will become apparent from the following description of exemplary embodiments (with reference to the attached drawings).

DESCRIPTION OF THE EMBODIMENTS

Hereinafter, a preferred embodiment of the present invention will be described in detail with reference to the drawings.

First Embodiment

Figure 5:
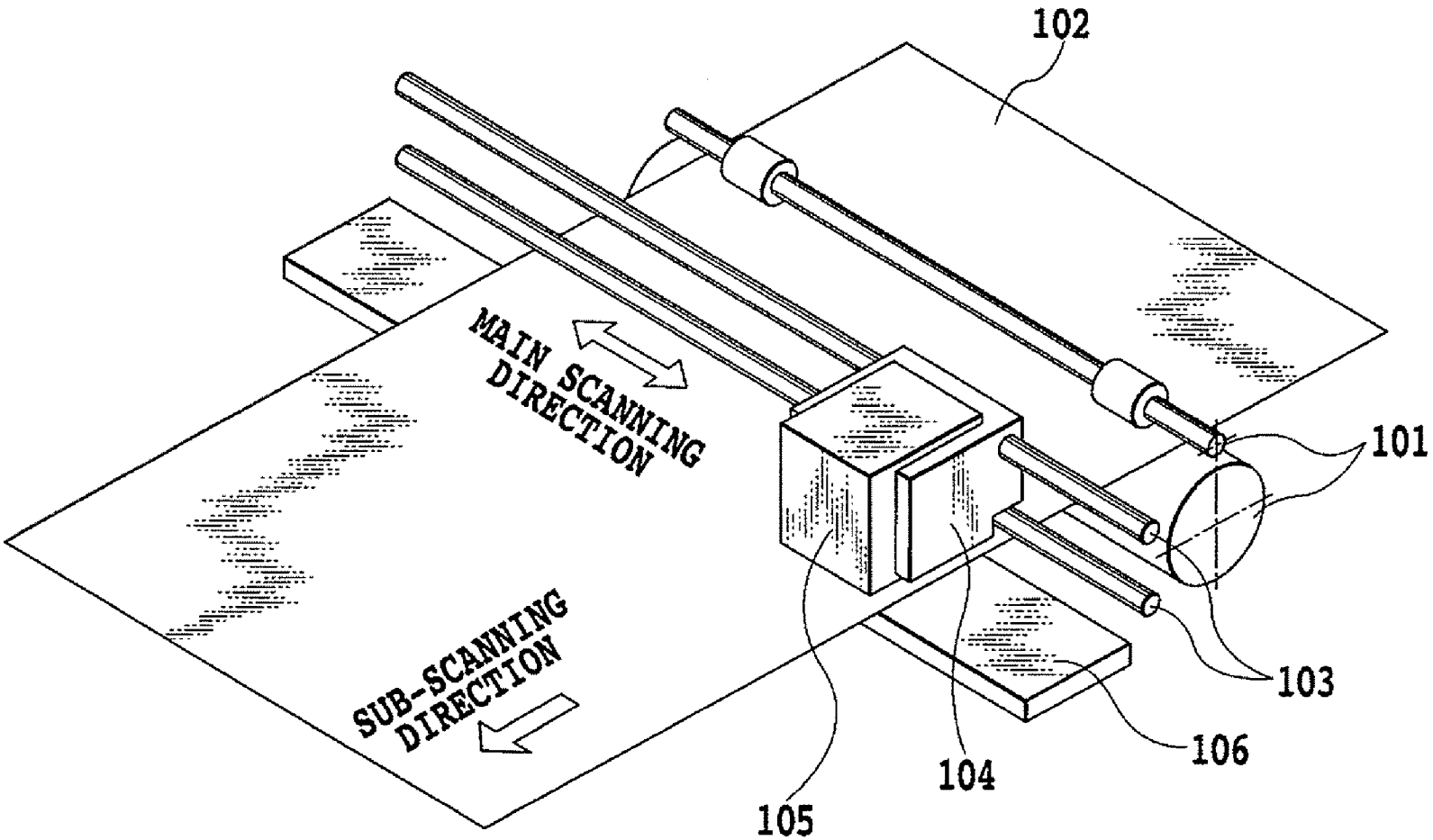
FIG. 5 is a perspective view for explaining the structure of an ink jet printing apparatus applicable to the present invention.

FIG. 5 is a perspective view for explaining the structure of an ink jet printing apparatus applicable to the present invention. A pair of paper feed rollers 101 are rotated to sandwich a print medium 102 to transport the print medium 102 in a sub-scanning direction. A platen 106 supports, from the lower side, a region of the transported print medium 102 subjected to a printing operation to maintain an appropriate distance between the print medium 102 and an ejection opening face of a print head 105.

A print head 105 is detachably attached to a carriage 104 that moves along a guide shaft 103. The print head 105 ejects, while moving in the main scanning direction, ink droplets through a plurality of ejection openings based on a printing signal. As a result, the print medium 102 is printed in an amount corresponding to one print scanning operation. After the print scanning operation has performed the print medium 102 is transported in the sub-scanning direction in an amount corresponding to the printing width of the print head 105. By alternately repeating such print scanning operation and transportation, an image is sequentially formed on the print medium 102.

It is noted that ink ejected from the print head 105 is supplied from an ink supply apparatus (not shown) fixed in the apparatus. Although not shown, the apparatus also includes a print medium supply means for supplying a not-yet-printed print medium 102 to the pair of paper feed rollers 101 and a print medium discharge means for discharging a printed print medium. Furthermore, a recovery means for performing a maintenance processing of the print head 105 and a preparatory auxiliary means for example are also preferred in order to stably provide an effect of the present invention. These means may include, for example, a capping means for capping an ejection opening face of a print head, a cleaning means for cleaning such as foreign matters at a discharge opening face, a means for pressurizing or sucking the interior of the ejection opening, or a means for receiving ink ejected in a preparatory manner.

A print medium generally may be a plain paper or a paper exclusively used for an ink jet printer but also may be, for example, a sheet made of a different material (e.g., OHP sheet, compact disc). Furthermore, in the case of a DNA chip manufacture apparatus or a display manufacture apparatus using an ink jet printing method, a substrate consisting of an appropriate material corresponds to a print medium in the present invention.

Figure 6:
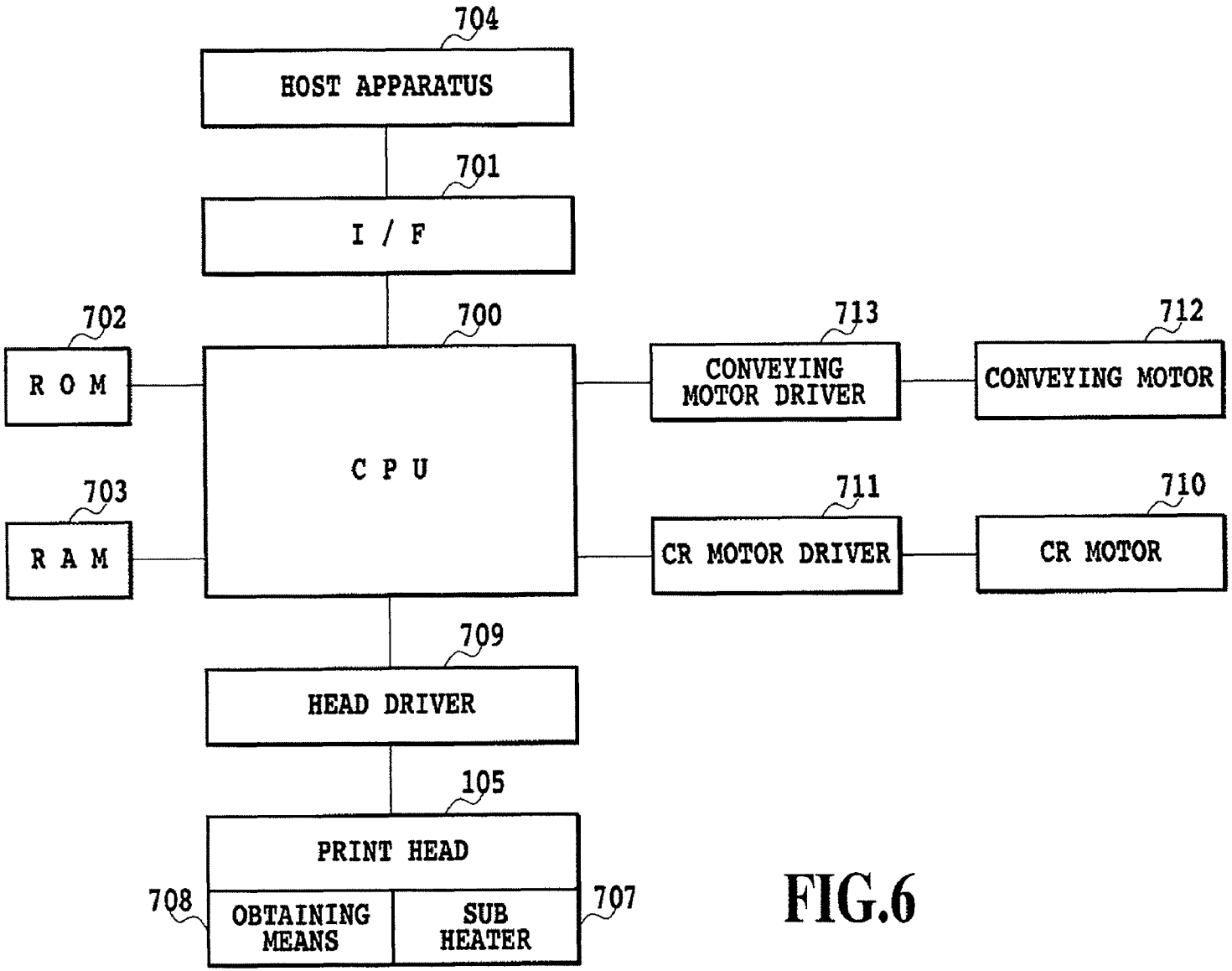
FIG. 6 is a block diagram for explaining the configuration of a control of ink jet printing apparatus applicable to the present invention.

FIG. 6 is a block diagram for explaining the configuration of a control of ink jet printing apparatus applicable to the present invention. In FIG. 5, a CPU 700 is a main control section that controls, based on various programs stored in a ROM 702, the operation of the entire apparatus. The ROM 702 stores therein the programs as well as required tables and fixed data for example. A driving pulse table used in this embodiment is also stored in the ROM 702. A RAM 703 is used as a region for the CPU 700 in which image data is developed and a working region.

A host apparatus 704 connected to the printing apparatus from outside is a supply source of image data. The host apparatus 704 may be a computer that prepares data for printing (e.g., image) or performs a processing for example and also may be a reading unit for reading image for example. Image data, a command, a status signal or the like is transferred between the host apparatus 704 and the CPU 700 via an interface (I/F) 701.

A head driver 709 is a driver that drives, based on print data for example, an electrothermal conversion body (heater) of the print head 105. The head driver 709 has: a shift register for arranging print data to correspond to a position of an electrothermal conversion element; a latch circuit for latching with an appropriate timing; and a logic circuit element for operating the electrothermal conversion element in synchronization with a drive timing signal.

The print head 105 includes obtaining means 708 for obtaining a temperature of ink near the heater (a temperature sensor for detecting the temperature of ink, for example) and a sub heater 707 for heating the print head until an appropriate temperature is reached. The sub heater 707 is provided for a temperature adjustment purpose in order to provide a stabilized ink ejection characteristic. The sub heater 707 may be formed on a substrate of a print head together with an electrothermal conversion element or also may be attached to a body of the print head 105. The obtaining means 708 may be a configuration obtaining temperature information of ink inside of the print head instead of the temperature information of ink mentioned above.

A carriage motor driver 711 is a motor for driving a carriage motor 710 that provides a transfer force of the carriage 104. A conveying motor driver 713 is a driver for driving a conveying motor 712 that provides a power to rotate the paper feed rollers 101.

The following section will describe a driving control method as a characteristic of the present invention.

Figure 1A:
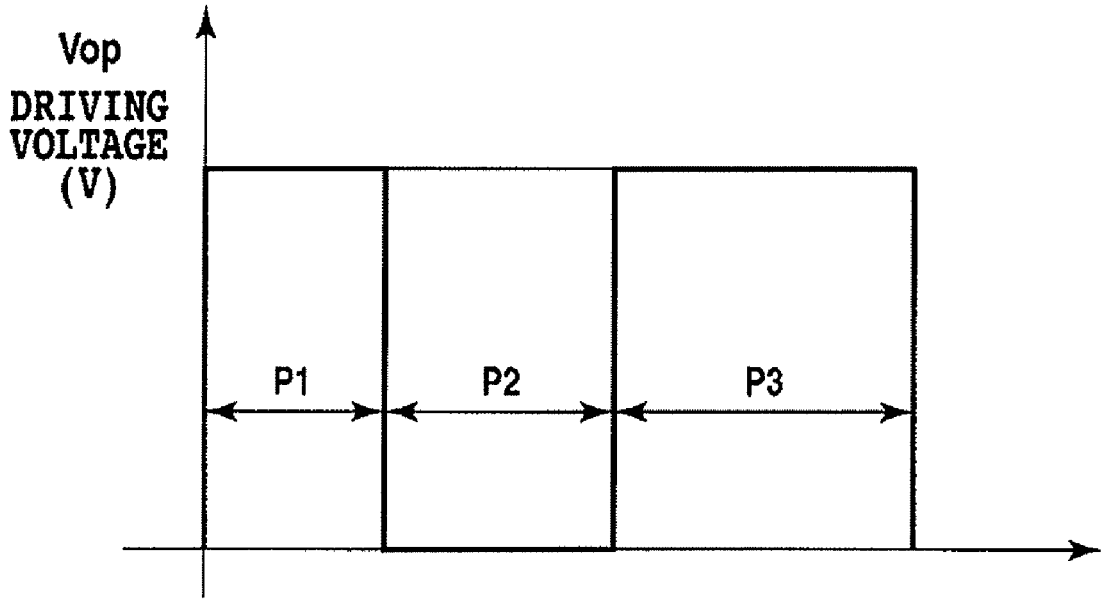
FIGS. 1A and 1B are a timing chart for explaining a PWM driving control.
Figure 1B:
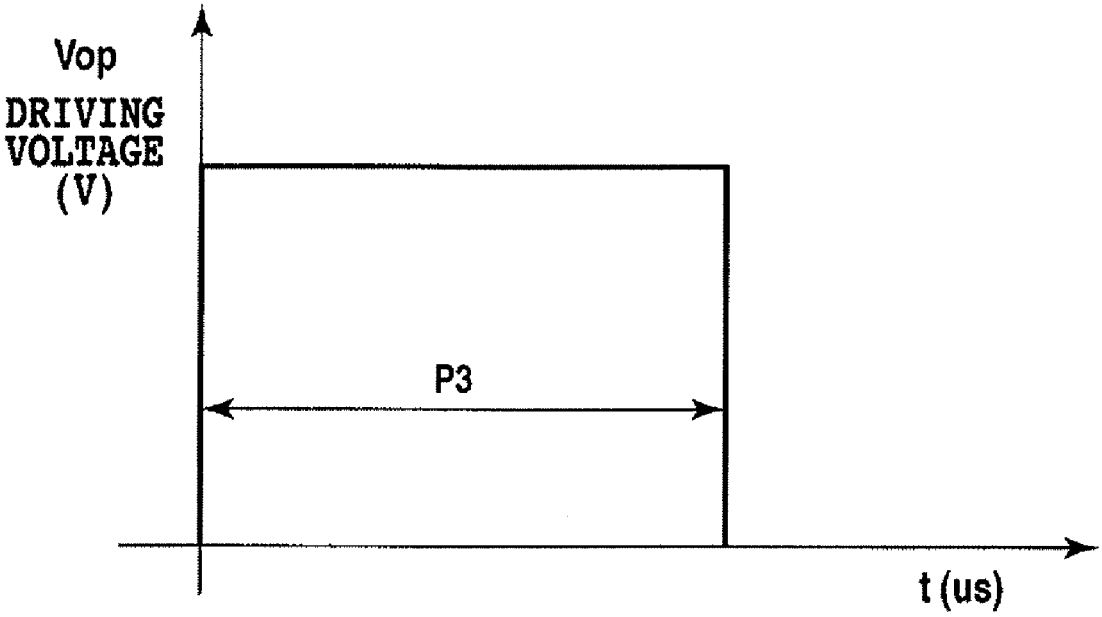
Figure 2:
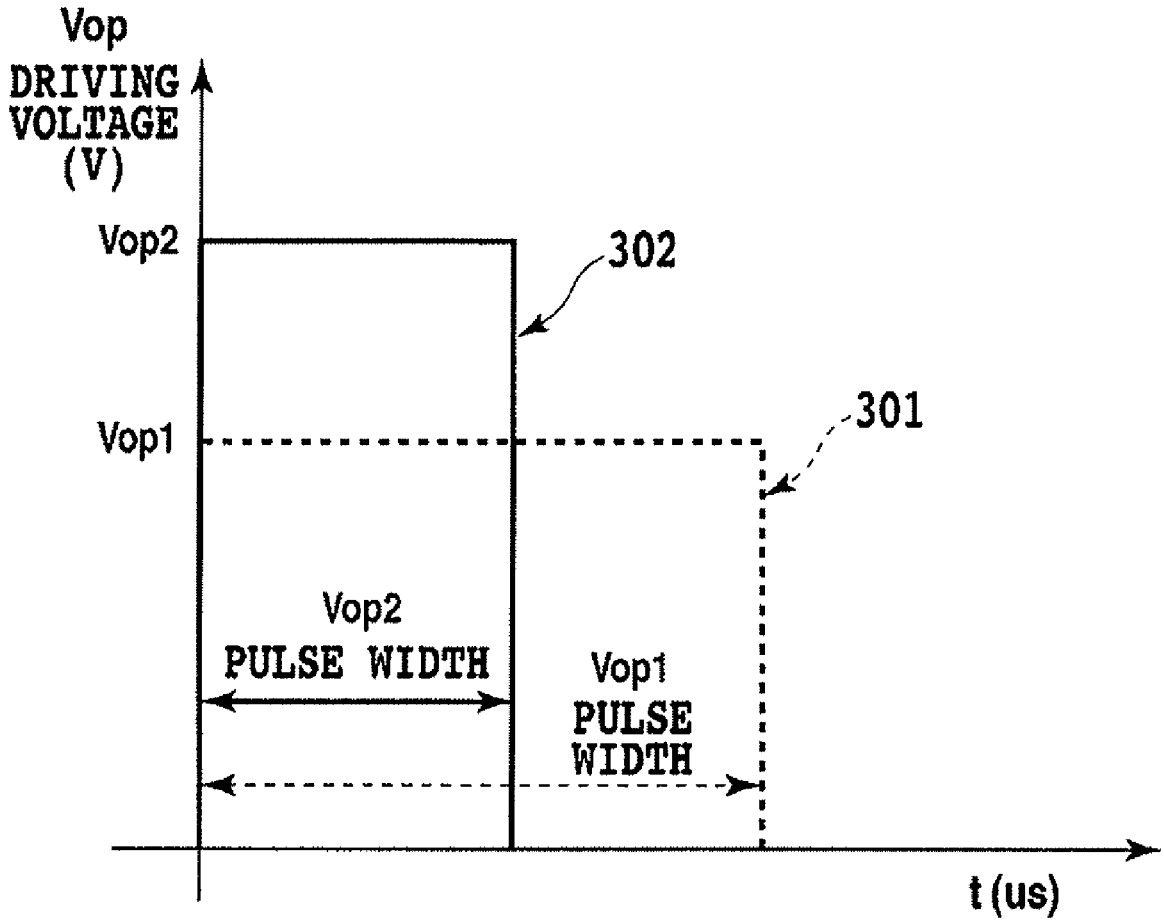
FIG. 2 is a timing chart for explaining a driving control method disclosed in the prior art.
Figure 3:
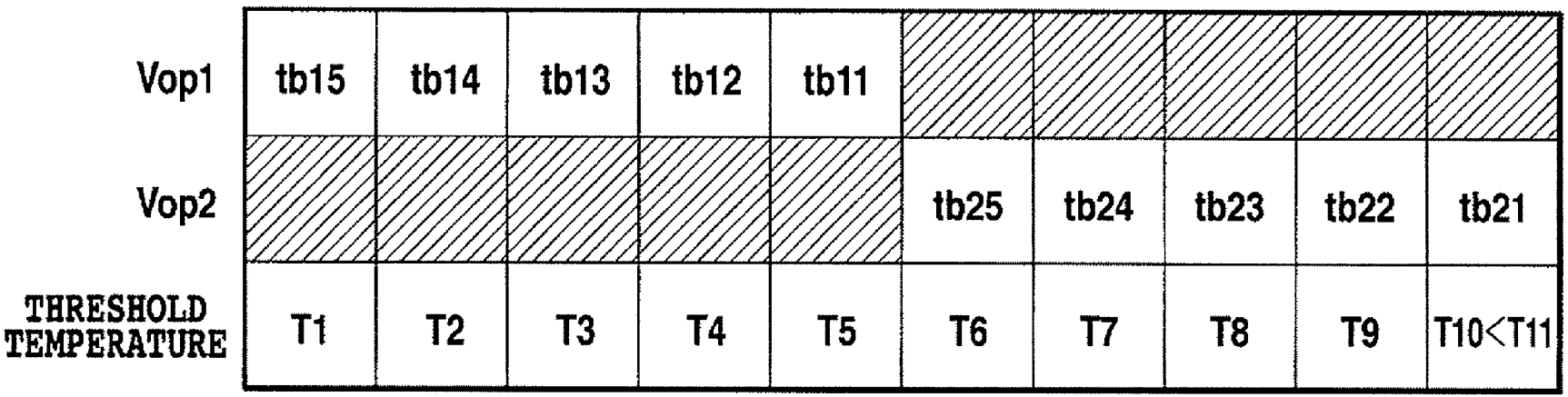
FIG. 3 shows a pulse table when two driving voltages Vop1 and VoP2 are used to perform a PWM driving control.
Figure 4:
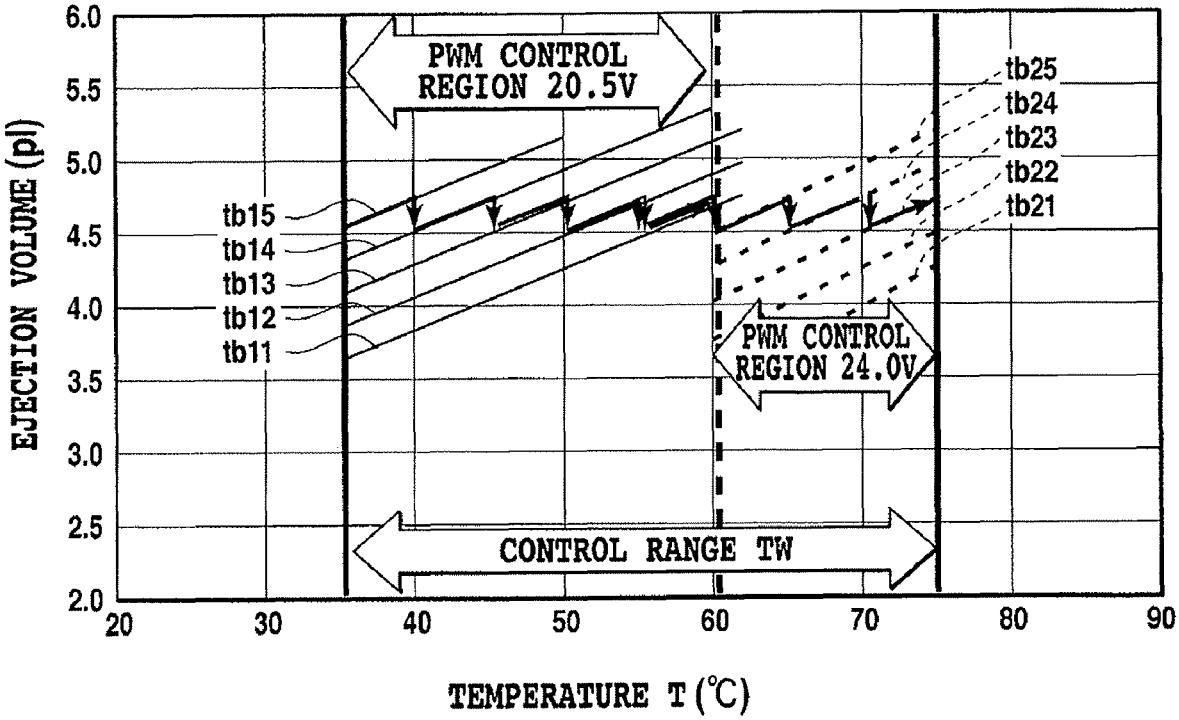
FIG. 4 illustrates a relation between a temperature T and an ink ejection volume and illustrates a control for switching the table showed in FIG. 3 depending on the temperature T to allow an ink ejection volume during a printing operation to be within a predetermined range.
Figure 7:
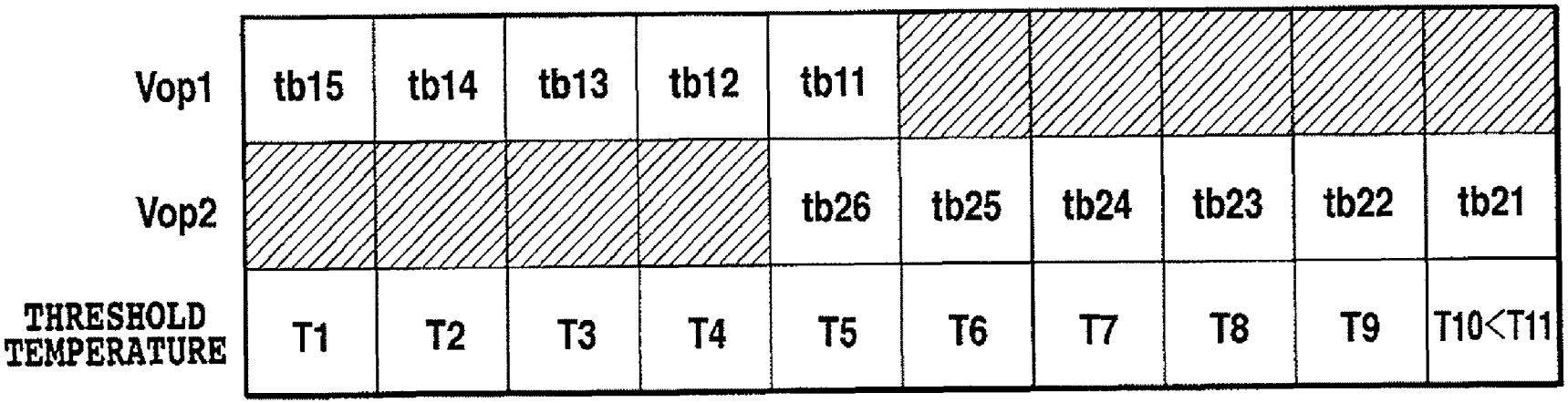
FIG. 7 illustrates a pulse table applicable to an embodiment of the present invention as in FIG. 3.

FIG. 7 illustrates a pulse table applicable to the embodiment of the present invention as in FIG. 3. This pulse table also shows two driving voltages Vop1 and Vop2 used for performing a PWM driving control. However, this embodiment prepares two types of pulses of tb11 and tb26 to detected temperatures T having a relation of T5<T<T6. In FIG. 6, "tb11" represents a double pulse having a driving voltage Vop1 and "tb26" represents a double pulse having a driving voltage Vop2. These two pulses have pulse widths corresponding to the respective voltage values so that the two pulses realize a substantially equal ink ejection volume. By providing the pulse table as described above, even when a temperature rises from T5 to T6, a previous print scanning is completed with pulse information of tb11 and the subsequent print scanning can be started with pulse information of tb26.

Figure 8:
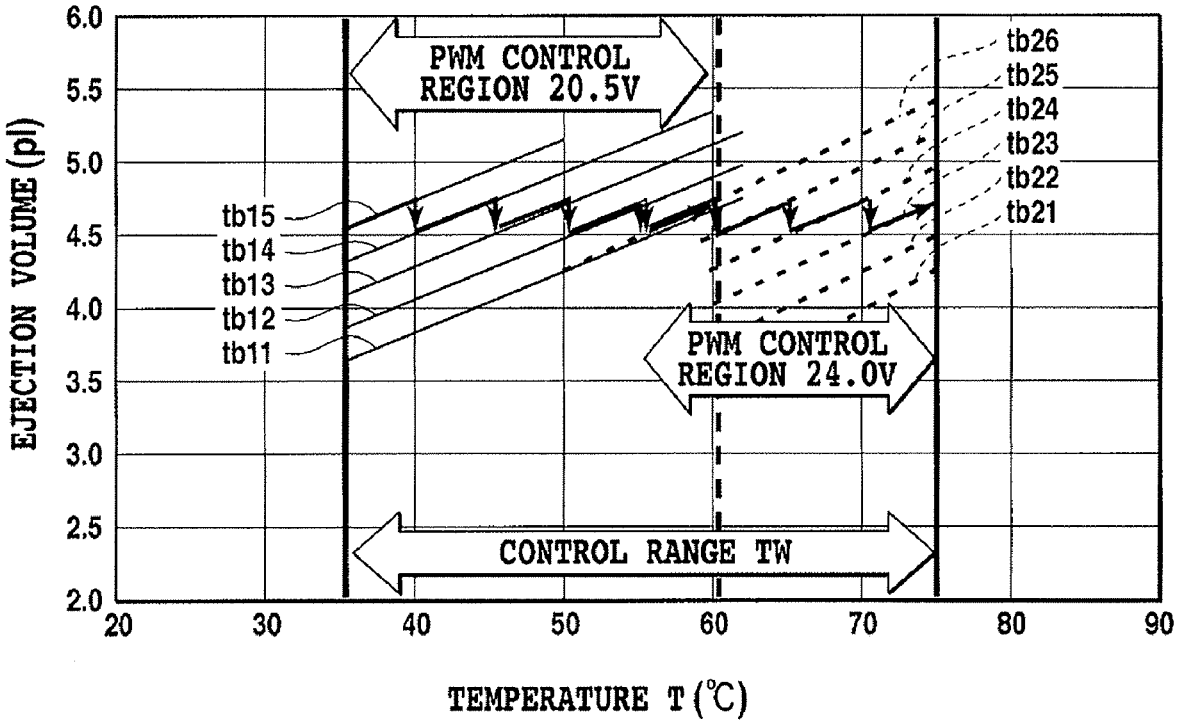
FIG. 8 illustrates a relation between a temperature T and an ink ejection volume and illustrates a control for switching a table showed in FIG. 7 depending on the temperature T to allow an ink ejection volume during a printing operation to be within a predetermined range.

FIG. 8 illustrates a relation between a temperature T and an ink ejection volume and illustrates a control for appropriately switching a table depending on the temperature T to allow an ink ejection volume during a printing operation to be within a predetermined range. In FIG. 8, the horizontal axis represents the detected temperature T and the vertical axis represents an ink ejection volume. The straight lines for tb11 to tb15 and the broken lines for tb21 to tb26 correspond to tables tb11 to tb15 and tb21 to tb26 shown in FIG. 7 and represent an ejection volume to the temperature T when the heater is fixedly driven based on the respective tables.

When the heater is driven based on any of the tables, an ink ejection volume substantially linearly uprise with a rate of about 0.4(Pl)/10 degrees to the temperature T (detected temperature). Specifically, when a driving control is performed based on only one table, an ink ejection volume rises by about 0.4 pl with an increase of a detected temperature of 10 degrees. According to the printing apparatus of this embodiment, it was confirmed that a very small problematic image is caused if fluctuation of an in ejection volume is equal to or lower than 0.2 pl. Based on this, this embodiment has prepared a plurality of pulse tables different in an ink ejection volume of about 0.2 Pl for a single temperature so that these pulse tables are switched whenever the detected temperature T increases by 5 degrees. When such a PWM control is employed and the detected temperature T gradually rises from T1, a table switching is performed to draw a locus as shown by the thick arrow. By doing this, an ink ejection volume can be maintained within a control range width (from about 4.5 pl to 4.7 pl) regardless of the detected temperature T.

When the PWM control is performed with a fixed driving voltage, the temperature T at which a preheat pulse width is 0 is an upper limit of a controllable temperature. For example, when a driving voltage Vop is 20.5V, 60 degrees is an upper limit of a controllable temperature. Thus, this embodiment prepares, in addition to the five tables tb11 to tb15 having a driving voltage of 20.5V, new PWM control tables tb21 to tb26 having a driving voltage of 24.0V to further uprise the upper limit of a controllable temperature.

In this case, with regards to a temperature close to a temperature at which a driving voltage is switched (60 degrees), two tables (tb11 and tb26) are prepared to correspond to two driving voltages (20.5V and 24.0V) and a region is provided at which PWM driving control ranges are overlapped so that any of the driving voltages can be used. FIG. 8 illustrates the PWM control explained above. The control range TW includes two types of PWM control regions, which are PWM control region for 20.5V and PWM control region for 24.0V. In the range from 55 degrees to 60 degrees, tb11 showed by a solid line and tb26 showed by a broken line are prepared. This means that two types of PWM control region are overlapped within a range from 55 degrees to 60 degrees.

The existence of such an overlapped region is a characteristic of the present invention. It is effect of the invention that, when a temperature covered by an overlapped region is detected, a convenient table can be selected from among the tables.

Figure 9:
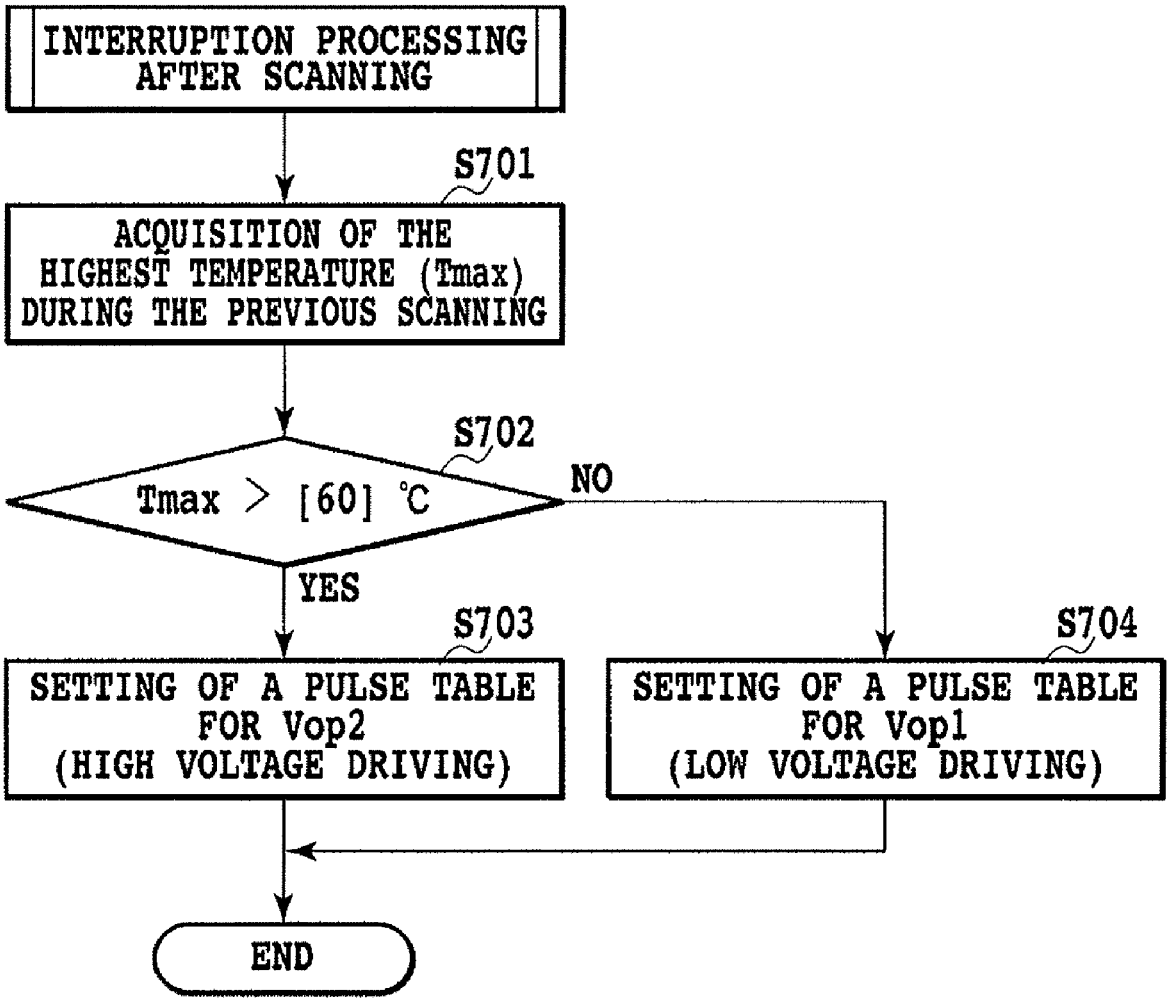
FIG. 9 is a flowchart for explaining an interruption processing for a voltage setting performed for every print scanning.

FIG. 9 is a flowchart for explaining an interruption processing for a voltage setting performed for every print scanning. When one print scanning is completed, firstly at a Step S701, the highest value Tmax of temperatures detected during a previous print scanning operation is obtained. Next, at Step S702, it is determined whether the obtained Tmax exceeds a switching temperature T5=60 degrees or not. When Tmax>60 degrees is determined, the processing proceeds to Step S703 to set that the subsequent print scanning performs a PWM control based on Vop2 (i.e., a pulse table having a driving voltage of 24.0V). On the other hand if Tmax<60 degrees is determined at the Step S702, the processing proceeds to Step S704 to set that the subsequent print scanning performs a PWM control based on Vop1 (i.e., a pulse table having a driving voltage of 20.5V).

Generally, a head temperature tends to be increased during a print scanning operation. Thus, when Tmax>60 degrees is determined at the Step S702, the head may have a temperature exceeding 60 degrees during the subsequent print scanning operation with a high probability, even when the head at the previous print scanning operation has a temperature equal to or lower than 60 degrees. In such a case, when a driving voltage at the start of a print scanning operation is set as Vop1 (i.e., 20.5V), a voltage must be changed during a print scanning operation. However, when an overlapped region with a certain amount is provided at a temperature close to the switching temperature 60 degrees as in this embodiment, a driving voltage of Vop2 (i.e., 24.0V) can be set even when the then detected temperature is lower than 60 degrees. Even when the subsequent print scanning causes a head temperature exceeding 60 degrees, an ink ejection volume can be controlled without changing the driving voltage.

Although the above section has determined a driving voltage for the subsequent print scanning operation based on the highest temperature Tmax detected during the previous print scanning, a driving voltage can be determined in consideration of various parameters. For example, a temperature rise can be predicted based on the number of ink ejections during the subsequent print scanning to determine, based on the predicted result, a driving voltage for the subsequent print scanning. In this case, the number of dot (or data amount) may be counted in advance.

By the PWM driving control in two steps as described above, the printing apparatus of this embodiment can control an ink ejection volume within a range of the detected temperature T of 35 degrees<T<75 degrees (see FIG. 8). It is noted that such an ejection volume control range is the one determined based on the characteristic of the print head rather than a controllable range of the PWM driving. The reason is that, even when an ejection volume is stabilized by the PWM control, an excessive temperature rise or an insufficient temperature of a print head may cause a defect in the ejection performance or the quality of a printed image. Thus, a temperature range within which such a defect is not caused is determined a printing-permitted temperature range. When a temperature out of this range is detected, the printing apparatus of this embodiment is controlled so as not to perform a printing operation.

In this embodiment, a print head is heated by the sub heater 709 when the detected temperature T has a relation of T<35 degrees and no printing operation is performed until T≧35 degrees are established. However, a method for heating a print head is not limited to this. For example, another method also may be used in which the respective heaters are applied with a short pulse not causing ink ejection to heat ink. When the detected temperature T has a relation T>75 degrees on the other hand, a printing operation is stopped immediately to wait for a relation of T<75 degrees.

Second Embodiment

Hereinafter, the second embodiment of the present invention will be described. The second embodiment also uses the ink jet printing apparatus shown FIGS. 5 and 6 as in the first embodiment. However, a print head of the second embodiment includes three chip columns each of which has an arrangement of a plurality of ejection openings. A power source circuit for supplying a common driving voltage to the three chips and a means for measuring a temperature of each chip is provided so that each chip is subjected to a PWM driving control. It is noted that the respective three chips may eject different ink or also may eject the same type of ink.

Figure 10:
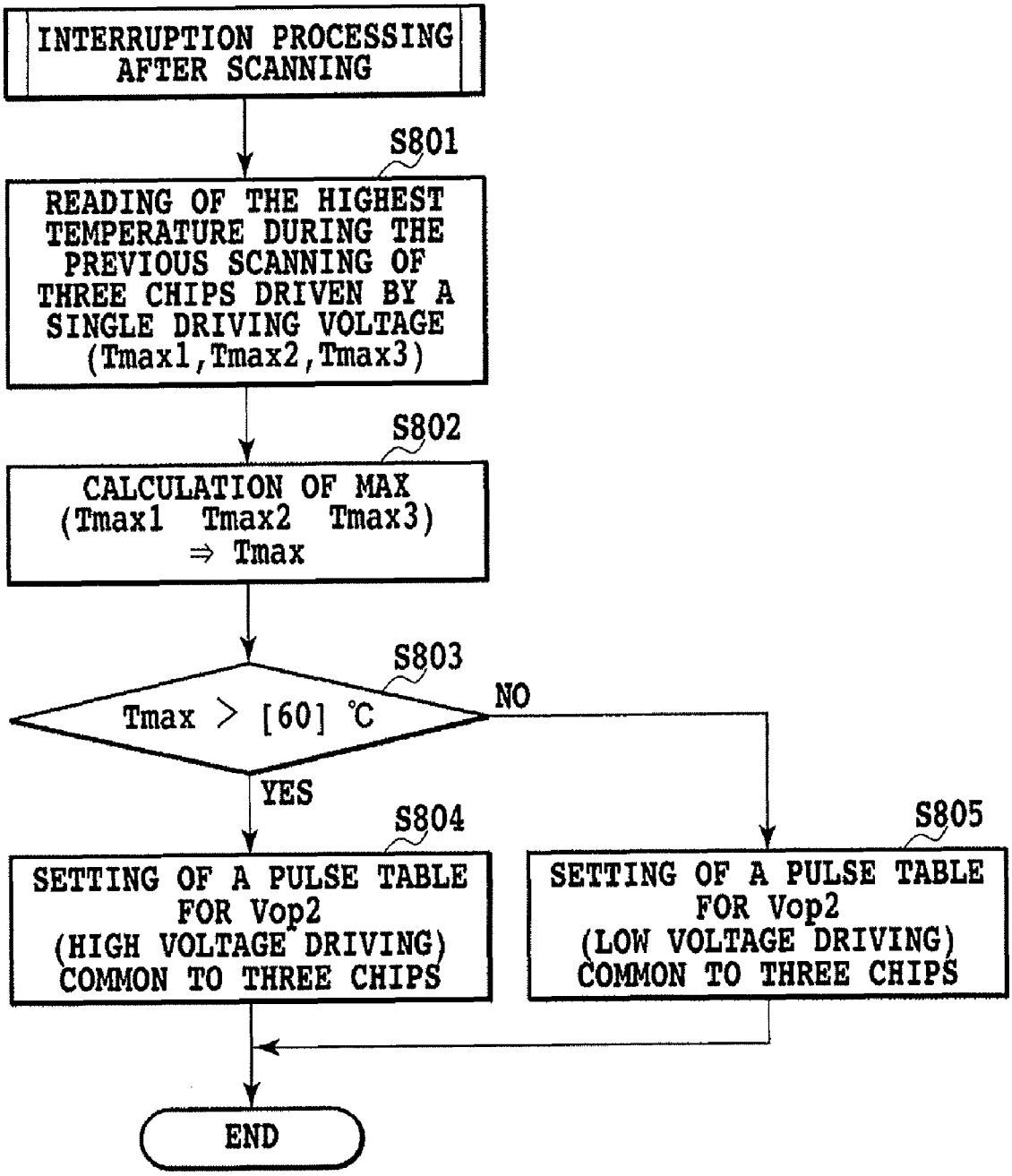
FIG. 10 is a flowchart for explaining a voltage setting in an ink jet printing apparatus of this embodiment performed for every print scanning.

FIG. 10 is a flowchart for explaining an interruption processing for a voltage setting in an ink jet printing apparatus of this embodiment performed for every print scanning. When one print scanning operation is completed, at the Step S801 firstly, the highest value of detected temperatures during the previous print scanning operation for every chip (Tmax1, Tmax2, and Tmax3) are obtained. Then, at Step S802, the highest temperatures (Tmax1, Tmax2, and Tmax3) of the three chips are compared to be selected the highest detected temperature Tmax among the chips. Furthermore At Step S803, whether the obtained Tmax exceeds a switching temperature T5=60 degrees or not is determined. When Tmax>60 degrees is determined, the processing proceeds to Step S804 to set the subsequent print scanning so as to subject the respective three chips to a PWM control with a fixed driving voltage of Vop2 (i.e., 24.0V). When at the Step S803, Tmax<60 degrees is determined on the other hand, the processing proceeds to Step S805 to set the subsequent printing scanning so as to subject the respective three chips to a PWM control with a fixed driving voltage of Vop1 (i.e., 20.5V).

Generally, in a print head including a plurality of chips, a different temperature is detected among each chip depending on an ejecting frequency of each chip.

Figure 11:
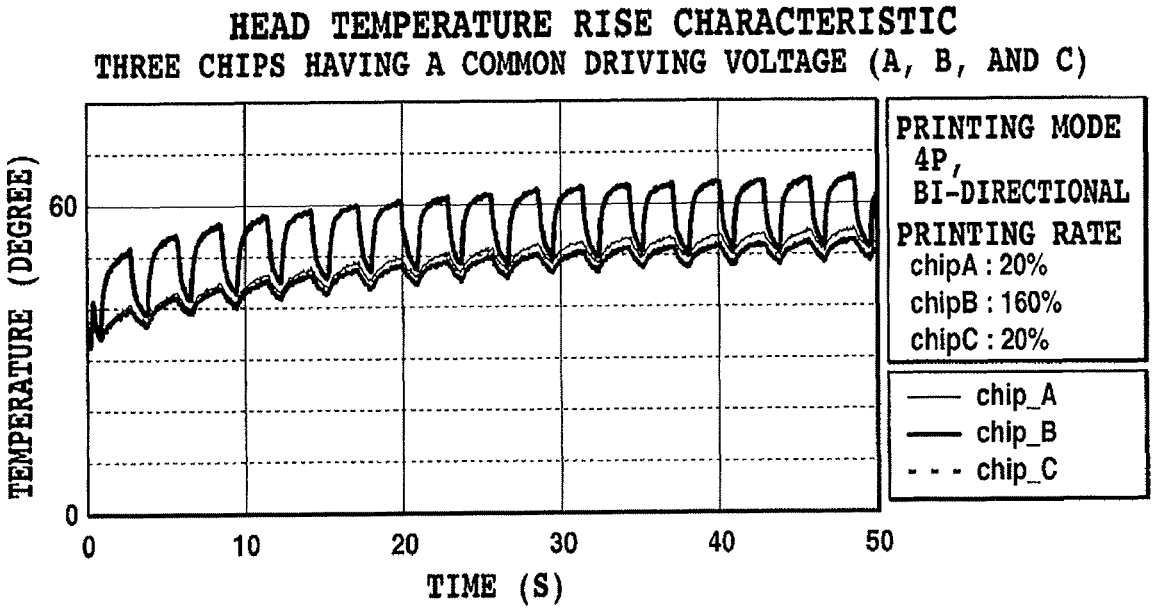
FIG. 11 illustrates a temperature rise of three chips A, B, and C included in a print head when the print head is used to perform a printing operation.

FIG. 11 illustrates a temperature rise of three chips A, B, and C included in a print head when the print head is used to perform a printing operation. The horizontal axis represents a time passed since the start of a printing operation and the vertical axis represents a detected temperature of the chips. The result shown in FIG. 11 is obtained by bidirectionally printing a uniform image with four-pass type multi-pass printing. And the uniform image is printed by the respective chips A, B, and C with a printing ratio of the chip A of 20%, a printing ratio of the chip B of 160%, and a printing ratio of the chip C of 20%. The printing ratio of the chip B is higher than those of the other chips A and C. Thus, the chip B shows detected temperatures in every print scanning operation higher than those of the other chips A and C.

In such a case, when a driving voltage is set based on the flowchart described with reference to FIG. 10, Step S802 always shows the detected temperature of the chip B at Tmax. When about 20 seconds have passed since the start of the printing operation, a driving voltage is switched from 20.5V to 24.0V for all of the three chips. However, at this point of time, the detected temperatures of the chips A and C do not reach 60 degrees yet. Thus, when determination is made only based on these two chips A and C, a driving voltage of 20.5V is appropriate. Even in such a case, by previously preparing the table shown in FIG. 7 as described in the first embodiment that is by providing an overlapped region of two PWM control ranges at a temperature close to 60 degrees, a single driving voltage can be used for the three chips.

It is noted that, although the above embodiment has prepared two types of PWM tables as shown in FIG. 7 only for a region for which the detected temperature T satisfies the relation of T5<T<T6, an overlapped region also may be provided for a further wider temperature range in the present invention.

Figure 12:
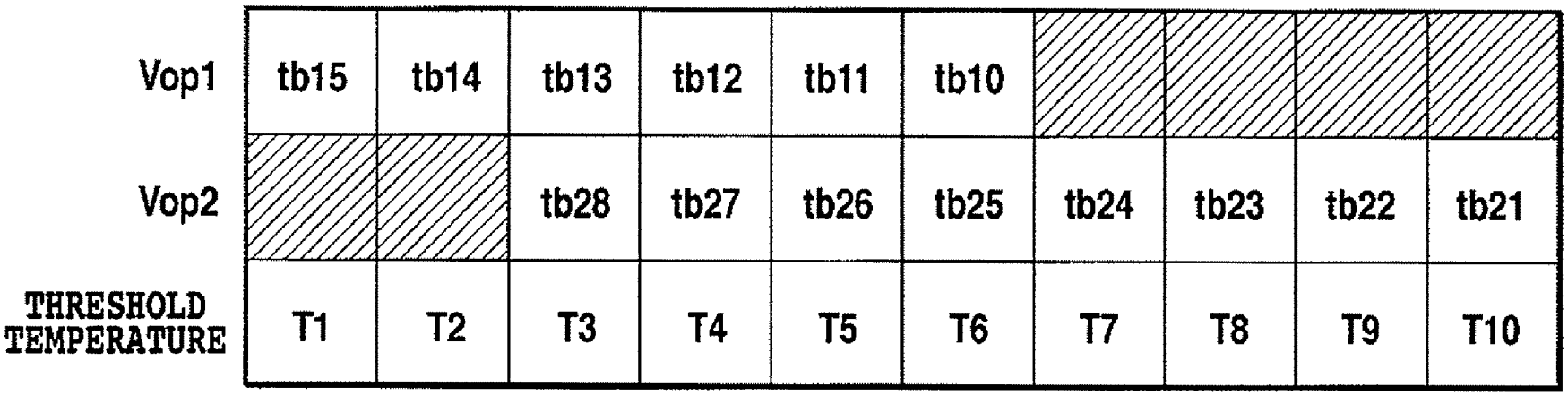
FIG. 12 illustrates a pulse table when an over lapping region of PWM control ranges of VoP1 and Vop2 is established in a range of T3<T<T7.
Figure 13:
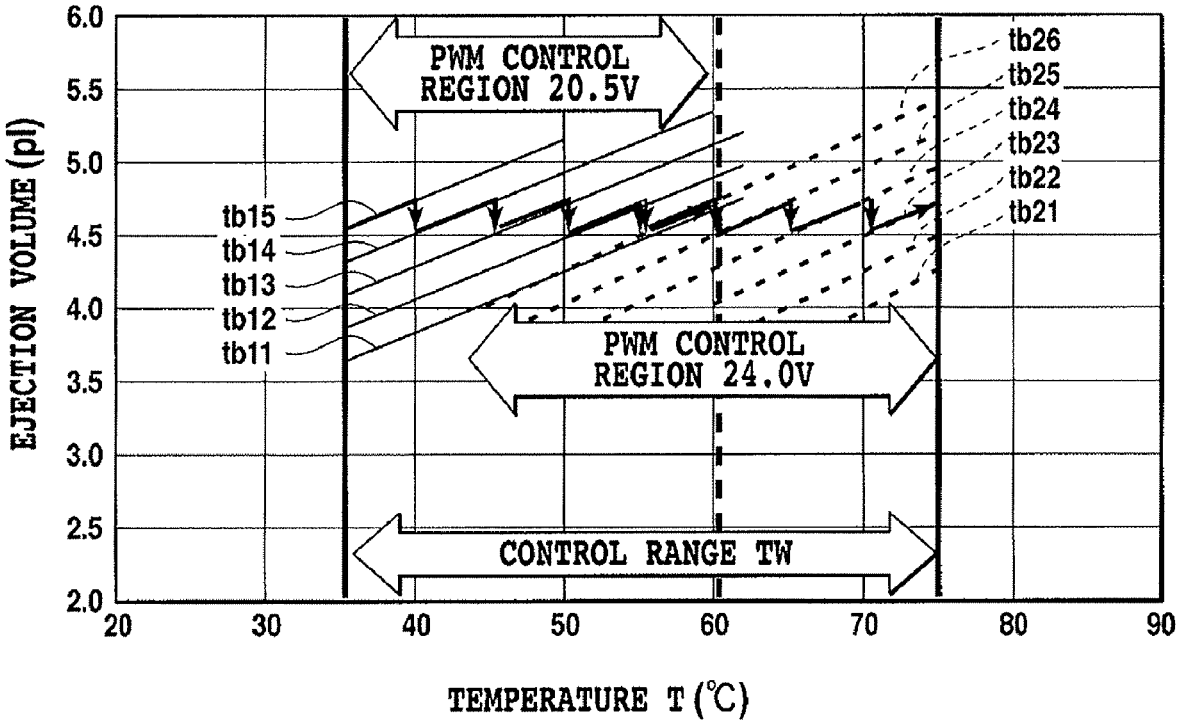
FIG. 13 illustrates a relation between a temperature T and an ink ejection volume and illustrates a control for switching a table showed in FIG. 12 depending on the temperature T to allow an ink ejection volume during a printing operation to be within a predetermined range.

FIG. 12 illustrates a pulse table when PWM control ranges of VoP1 and Vop2 are overlapped within a region in which a relation of T3<T<T7 is established. Additionally, FIG. 13 illustrates a relation between a temperature T and an ink ejection volume when the pulse table showed in the FIG. 12 is employed. In FIG. 13, the overlapped region of two types of PWM control region is larger than that of FIG. 8. This is regarding a case in which a temperature depression after a print scanning is large. That is, the pulse table is made up so that the overlapped region (temperature range) of the two types of PWM control region is larger than a range of temperature depression (changing) during a print operation. Another way of saying, the pulse table is made up so that the overlapped region is larger than the range of temperature depression (changing) caused by an interspace between print scannings. Specifically, when a print scanning is performed by scanning the print head, the overlapped region (temperature range) of the PWM control regions is larger than a range of temperature changing during the interspace between a preceding print scanning and a following print scanning. By making up the pulse table described above, an appropriate voltage value and an appropriate pulse width can be selected after a print scanning and before a following print scanning.

As described above, by setting a further wider overlapped region of different PWM driving control ranges, a PWM control (head driving control) can be more appropriately realized when a difference in the detected temperature between chips is significant or when a temperature change between print scanning operations is different among chips. Even when a significant temperature change width is anticipated in a single print scanning operation, a PWM control by the same driving voltage can be realized in the single print scanning. In other words, even when a temperature change is significant in the print scanning, the time at which a driving voltage is switched can be reduced.

In addition, FIG. 12 shows eight Vop2 tables and six Vop1 tables. Thus, a control width for Vop2 is wider than that for Vop1. By this, the control of a pulse width depending on a voltage level and a temperature level can be more appropriately performed when compared with the case of FIG. 7.

Although the above embodiment has described a control of an ink ejection volume by two PWM controls based on two driving voltages of Vop1 of 20.5V and Vop2 of 24.0V, the present invention also can be applied to a PWM driving control based on three or more driving voltages. In this case, the overlapped region as described above is preferably provided in each of a plurality of regions for which a driving voltage is switched.

Although the above embodiment has described a driving pulse having a so-called double pulse shape, the invention also can be applied to a single pulse or one table also can include a double pulse and a single pulse.

In the above embodiment, different threshold values also can be used for a switching from Vop1 to VoP2 and a switching from Vop2 to Vop1.

By providing an overlapped region to two PWM control ranges as shown in FIG. 7 or FIG. 12 to provide a plurality of orders for switching tables, such an order can be selected that minimizes the deterioration of the continuity of an ink ejection volume or an image density. In this case, an optimal table can be selected in consideration of various factors such as an inclination of a temperature change, fluctuation of a printing rate, or an environment temperature.

Although the above embodiment has exemplarily described the serial-type ink jet printing apparatus in which a main scanning by a print head and the transportation of a print medium are alternately performed to form an image, the present invention is not limited to such an embodiment. The present invention also can be applied to a full line type ink jet printing apparatus in which nozzles of a print head are arranged in accordance with a printing width of a print medium. The full line type ink jet printing apparatus prints an image for one page by ejecting ink from the respective nozzles of the print head with a predetermined frequency while transporting a print medium in a sub-scanning direction. Thus, by assuming that one print scanning operation of the above-described serial type printing apparatus corresponds to a print operation for one page by the full line type printing apparatus, the pulse table shown in FIG. 7 or FIG. 12 can be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-157664, filed Jun. 6, 2006, which is hereby incorporated by reference herein in its entirety.

What is claimed is:

1. An ink jet printing apparatus for performing a printing operation by scanning a print head including a plurality of print elements for ejecting ink, comprising:

obtaining means for obtaining temperature information of the print head during each scanning operation and for obtaining maximum temperature information of the print head at the previous scanning operation;

driving means for driving the print elements by using a pulse signal comprising a preheat pulse and a main heat pulse;

selection means for selecting a voltage value of the pulse signal for the next scanning operation based on both of the maximum temperature information obtained by the obtaining means and threshold information corresponding to the voltage value at the previous scanning operation and for selecting a pulse width corresponding to the voltage value for the next scanning operation; and control means for starting to drive the print elements based on the voltage value and the pulse width selected by the selection means for the scanning operation of the print head, and for changing the pulse width during the scanning operation, based on the temperature information obtained by the obtaining means during the scanning operation.

2. An ink jet printing method for performing a printing operation by scanning a print head including a plurality of print elements for ejecting ink, comprising steps of:

obtaining temperature information of the print head during each scanning operation and for obtaining maximum temperature information of the print head at the previous scanning operation;

driving the print elements by using a pulse signal comprising a preheat pulse and a main heat pulse;

selecting a voltage value of the pulse signal for the next scanning operation based on both of the maximum temperature information obtained by the obtaining step and threshold temperature corresponding to the voltage value at the previous scanning operation and a pulse width corresponding to the selected voltage value for the next scanning operation; and controlling for starting the driving step based on the voltage value and the pulse width selected by the selection step for the scanning operation, and for changing the pulse width based on the temperature information obtained by the obtaining step during the scanning operation.

3. An ink jet printing apparatus according to claim 1, wherein the selecting means does not select the voltage value during a print operation of the print head.

4. An ink jet printing apparatus according to claim 1, wherein when the maximum temperature is higher than the threshold information, the selecting means selects a first voltage, which is higher than a second voltage.

5. An ink jet printing apparatus according to claim 4, wherein the first range of the first voltage and the second range of the second voltage include a temperature region at which the first range and the second range are partially overlapped to each other.

6. An ink jet printing method according to claim 2, wherein the maximum temperature is higher than the threshold information, setting a first voltage, which is higher than a second voltage.

7. An ink jet printing apparatus according to claim 4, wherein when the first voltage is about 24.0V and the second voltage is about 20.5V.

* * * * *